US005249921A

United States Patent [19]

Stueber et al.

[11] Patent Number: 5,249,921

[45] Date of Patent: Oct. 5, 1993

[54] COMPRESSOR OUTLET GUIDE VANE SUPPORT

[75] Inventors: Henry B. Stueber, Cincinnati; Eric E. Baehre, West Chester, both of Ohio

[73] Assignee: General Electric Company, Cincinnati, Ohio

[21] Appl. No.: 812,381

[22] Filed: Dec. 23, 1991

[51] Int. Cl.[5] ..... F01D 9/04

[52] U.S. Cl. ..... 415/138; 415/139; 415/208.2; 415/209.2; 415/209.3; 60/39.31; 60/39.32; 60/751

[58] Field of Search ..... 415/134, 136, 138, 139, 415/209.2, 209.3, 209.4, 210.1, 211.2, 208.1, 208.2; 60/39.31, 39.32, 751

[56] References Cited

U.S. PATENT DOCUMENTS

| | | | |
|---|---|---|---|
| 3,262,677 | 7/1966 | Bobo et al. | 415/139 |
| 3,302,926 | 2/1967 | Bobo | 415/210.1 |
| 4,076,451 | 2/1978 | Jankot | 415/209.2 |
| 4,483,149 | 11/1984 | Rider et al. . | |
| 4,487,015 | 12/1984 | Slattery . | |
| 4,503,668 | 3/1985 | Duncan, III et al. | 60/39.32 |
| 4,907,946 | 3/1990 | Ciokajlo . | |
| 5,077,967 | 1/1992 | Widener et al. | 415/211.2 |
| 5,118,120 | 6/1992 | Drerup et al. | 415/139 |
| 5,165,850 | 11/1992 | Humke et al. | 415/208.2 |

FOREIGN PATENT DOCUMENTS

| | | | |
|---|---|---|---|
| 1089660 | 11/1967 | United Kingdom | 60/39.32 |

*Primary Examiner*—Edward K. Look
*Assistant Examiner*—Christopher Verdier
*Attorney, Agent, or Firm*—Jerome C. Squillaro

[57] ABSTRACT

A compressor outlet guide vane (OGV) assembly includes inner and outer annular OGV walls, having outlet guide vanes mounted therebetween, are in abutting relationship with the corresponding leading edges of respective inner and outer diffuser casings and not welded to or otherwise supported by the leading edges of the diffuser casings as in the prior art. The OGV assembly is attached to an annular OGV support member that extends from a portion of a corresponding OGV wall circumscribing the thick section of the OGVs. This assembly decouples the inner and outer OGV annular walls from moments or thermally induced radial loads that may be transferred to the OGV walls due to the interface of the diffuser casings and OGV walls and which may in turn induce failure causing stresses in the OGV trailing edges.

One particular embodiment provides an inner conical OGV support member mounted to the inner annular OGV wall at its forward end and bolted, at its aft end, to the inner diffuser support member, which is typically cast integral with the diffuser, and with the inner turbine support member. Another embodiment provides inner and outer conical OGV support members engaging radially extending flange like extensions of corresponding inner and outer diffuser casings.

9 Claims, 2 Drawing Sheets

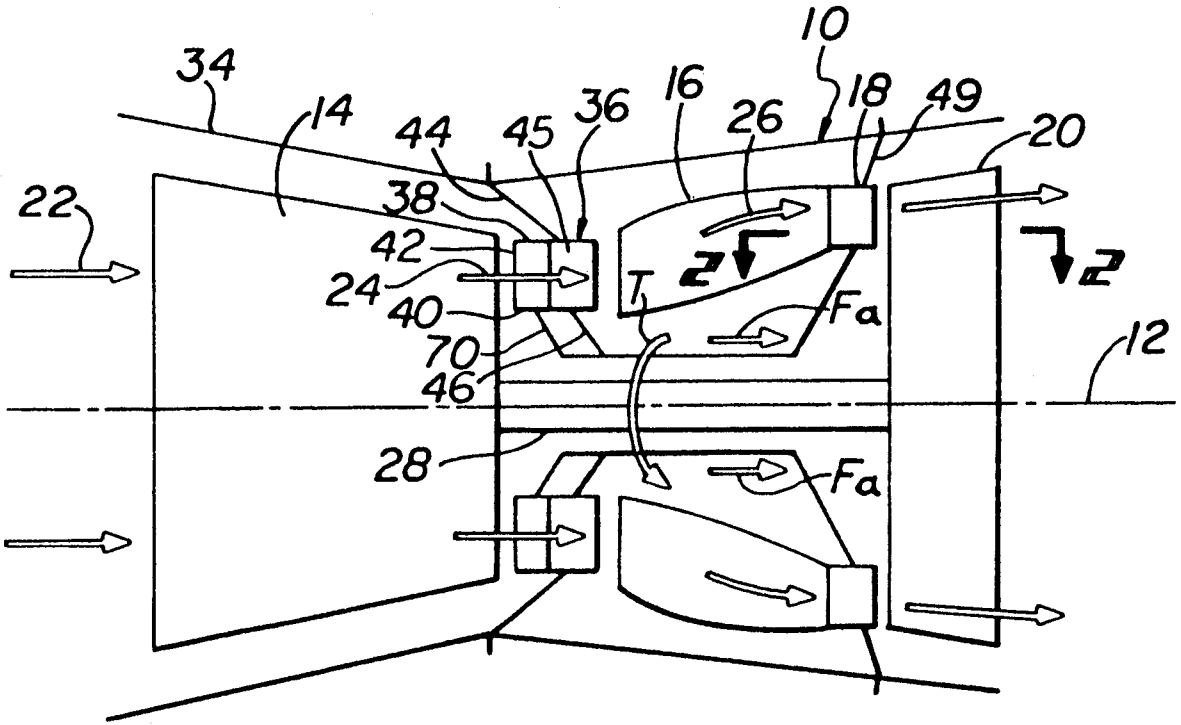
Hōgr - 1
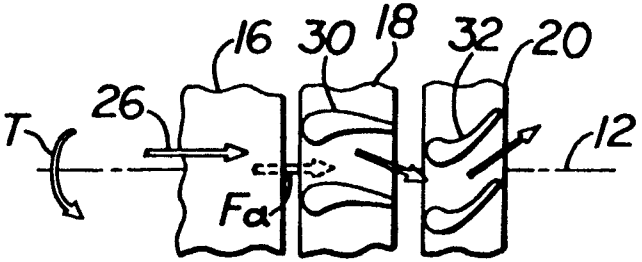
Hōgr - 2

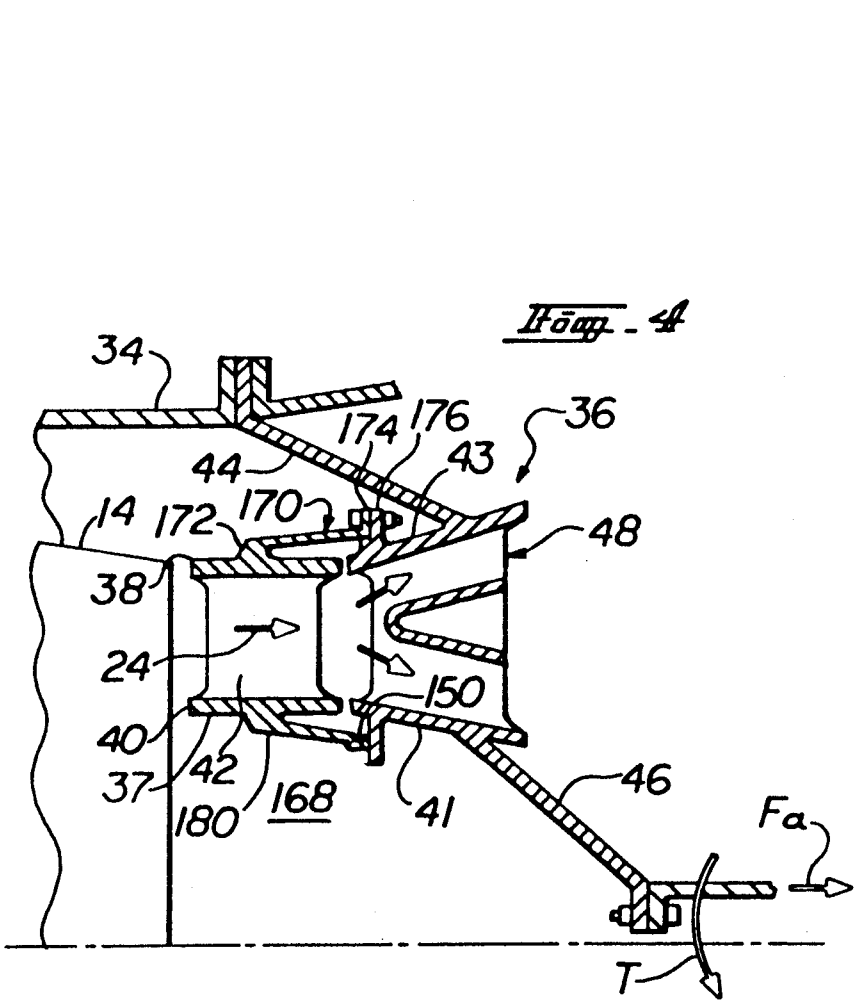
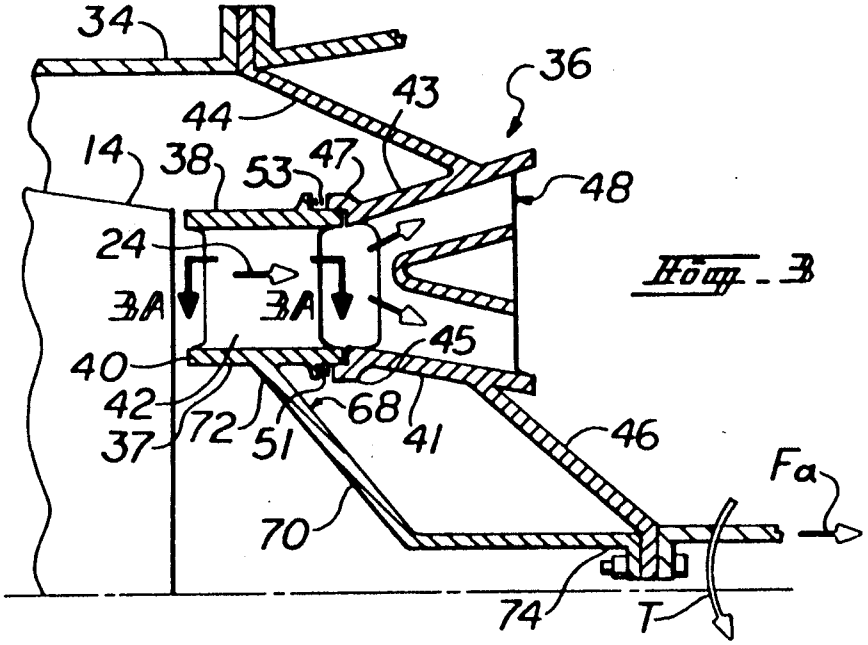
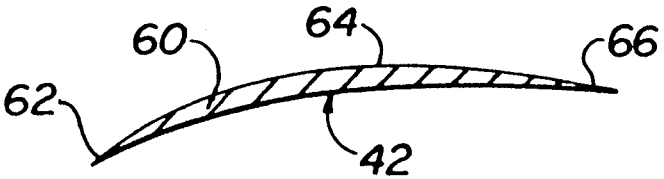
Fig. 3A

COMPRESSOR OUTLET GUIDE VANE SUPPORT

BACKGROUND OF THE INVENTION

1. Field of the Invention

The present invention relates generally to gas turbine engine compressor outlet guide vane stages and diffusers and, more specifically, to support of the outlet guide vane stage.

2. Background Art

A conventional gas turbine engine includes in serial flow communication a compressor, a discharge flowpath having a compressor outlet guide vane stage including compressor outlet guide vanes (OGVs) disposed between annular inner and outer walls which in turn are mounted in an OGV support structure mechanically tied into an engine casing. Outlet guide vanes typically have airfoil like cross-sections that include a leading edge, a relatively thick middle section, and a thin trailing edge. Downstream of the OGV stage is a combustor diffuser, a combustor, a turbine nozzle, and a high pressure turbine. Typically OGV stage inner and outer walls are supported by corresponding inner and outer annular diffuser inlet walls to form a relatively leak free flowpath therebetween and support the OGV stage. Such a design is illustrated in U.S. Pat. No. 4,483,149, entitled "Diffuser Case for A Gas Turbine Engine", by Gerald R. Rider et al, which issued on Nov. 20, 1984. Some other constructions welded corresponding inner and outer OGV walls and diffuser casings.

During engine operation, the compressor compresses inlet airflow, which is therefore heated thereby. The discharged compressed and heated airflow is then channeled through the OGVs and the diffuser to the combustor wherein it is conventionally mixed with fuel and ignited to form combustion gases. The combustion gases are channeled through the turbine nozzle to the high pressure turbine which extracts energy therefrom for rotating and powering the compressor.

A typical conventional engine has a support assembly for the OGVs and the combustor diffuser which includes an annular inner support extending downstream to the turbine nozzle which may be used to help support the turbine nozzle. An annular outer support extends radially outwardly from the OGVs and the diffuser and is fixedly connected to the casing surrounding the engine for supporting the OGVs and the diffuser.

The turbine nozzle includes a plurality of circumferentially spaced and angled nozzle vanes which conventionally direct the combustion gases into the high pressure turbine. A pressure drop exists across the turbine nozzle and the inner support which generates an axial force which is carried upstream through the inner support, the discharge flowpath, and the outer support to the casing. Since the nozzle vanes are angled, a circumferential component of force is also generated from the combustion gases which results in a torque relative to the engine centerline axis also being transmitted upstream through the inner support and the outer support to the casing.

During an engine thermal transient such as, for example, throttle push, the compressor OGVs and combustor diffuser experience relatively high and nearly instantaneous temperature change due to the relatively hot compressed airflow being discharged from the compressor. Although the inner support responds relatively quickly with the OGVs and the diffuser, the outer support and casing respond relatively slowly to the temperature change. Therefore, the OGVs and diffuser expand more rapidly relative to the outer support which outer support tends to restrain the radial growth thereof resulting in relatively high thermally induced stress at the interface thereof. To alleviate the problems due to this stress a new structural support was developed and is disclosed in a related U.S. Pat. application No. 07/729,956, entitled "Compressor Discharge Flowpath", filed on Jul. 15, 1991, and assigned to the same assignee.

The outer support is typically an annular, conical or cylindrical, surface of revolution or shell, which is relatively stiff requiring relatively large forces to cause deflection thereof. The relatively large thermal mass of the OGVs and combustor diffuser create both a radially outward deflection and rotation of the end of the relatively slowly expanding outer support connected thereto, with attendant large thermal stresses therein. In other words, the supporting end of the outer support shell is caused by the expanding OGVs and diffuser to both expand and twist radially outwardly relative to the outer support shell at distances away from its interface with the OGVs and the diffuser.

Accordingly, the relatively quickly expanding OGVs and diffuser expand radially outwardly to a greater extent than the relatively slowly expanding outer support shell resulting in a differential thermal movement, or expansion, therebetween. Furthermore, there exists a large thermal growth differential between the OGV's and the diffuser due to the disposition of the OGV's in front of the diffuser. The forward position and higher airflow velocities through the OGVs than through the diffuser results in the OGVs heating up quicker than the diffuser during engine acceleration such as during takeoff. This causes a thermal differential movement or growth between the OGVs and the diffuser. This differential thermal movement is accommodated by the bending of the outer support shell of the compressor diffuser at its welded intersection with the OGV's inner and outer platform trailing edges and the compressor diffuser resulting in high thermal stress therein. This induces high stresses at the trailing edges of the outlet guide vanes leading to cracking and premature failure. One method of alleviating this stress is to sector the OGV assembly but this has the disadvantage of creating flow leakage paths.

OBJECTS OF THE INVENTION

Accordingly, one object of the present invention is to provide a new and improved compressor outlet guide vane support configuration having reduced thermal stresses induced in the outlet guide vane trailing edges due to differential thermal movement between the outlet guide vane surrounding walls and the diffuser casings. Another object is to reduce stresses due to bending moments at the OGV and diffuser interface caused by portions of the axial force of the turbine nozzle that is reacted out to the engine casing and pulls on the inner diffuser casing against the outer diffuser casing to which it is tied by the OGVs and radially extending diffuser walls.

DISCLOSURE OF INVENTION

A compressor outlet guide vane (OGV) assembly for maintaining a compressor discharge flowpath includes inner and outer annular OGV walls, having outlet guide vanes mounted therebetween, are in abutting relationship with the corresponding leading edges of respective inner and outer diffuser casings. The OGV assembly is mounted to the diffuser by at least one annular OGV support member that extends from a position on a corresponding OGV wall circumscribing the thick section of the OGVs.

One particular embodiment provides an inner conical OGV support member mounted to the inner annular OGV wall at its forward end and bolted, at its aft end, to the inner diffuser support member, which is typically cast integral with the diffuser. Mechanical sealing of the flowpath between the OGV assembly and the diffuser is provided by W seals between respective radially extending flanges on the inner and outer annular OGV walls and the corresponding inner and outer diffuser casings.

A second embodiment provides inner and outer conical OGV support members mounted to corresponding inner and outer annular OGV walls and which are in gas path sealing relationship with corresponding diffuser inlet casings. The outer OGV support member is bolted to and sealed against a flange on the outer diffuser inlet wall to support member which is integrally cast with the diffuser. The inner annular OGV wall is in gas path sealing relationship with the inner diffuser inlet wall using an annular W seal between suitable corresponding seal surfaces of radially extending flanges of the inner OGV wall and diffuser casing. The inner OGV support member includes a contact support means in the form of an annular rim effective for providing retaining surfaces for a W seal while decoupling all radial, axial, and bending moment reactive forces between the OGV inner wall and inner diffuser casing.

BRIEF DESCRIPTION OF DRAWINGS

The novel features characteristic of the invention are set forth and differentiated in the claims. The invention, in accordance with preferred and exemplary embodiments, together with further objects and advantages thereof, is more particularly described in the following detailed description taken in conjunction with the accompanying drawing in which:

FIG. 1 is a schematic representation of an axial flow gas turbine engine including a compressor discharge flowpath in accordance with one embodiment of the present invention.

FIG. 2 is a transverse radial view of a portion of the engine illustrated in FIG. 1 taken along line 2—2.

FIG. 3 is an enlarged axial transverse view of the compressor discharge flowpath illustrated in FIG. 1 in accordance with one embodiment of the present invention.

FIG. 3*a* is cross-section of an outlet guide vane illustrated in FIG. 3.

FIG. 4 is an enlarged axial transverse view of the compressor discharge flowpath illustrated in FIG. 1 in accordance with another embodiment of the present invention.

MODE(S) FOR CARRYING OUT THE INVENTION

Illustrated in FIG. 1 is a schematic representation of a gas turbine engine 10 including in serial flow communication about an axial centerline axis 12 conventional annular and axisymmetric structures including an axial flow compressor 14, combustor 16, high pressure turbine nozzle 18, and high pressure turbine (HPT) 20. The compressor 14 receives inlet airflow 22 which is compressed therein for generating relatively hot compressed airflow 24 which is channeled to the combustor 16 wherein it is conventionally mixed with fuel and ignited for generating combustion gases 26. The gases 26 are channeled into the nozzle 18 and directed thereby through the HPT 20 which extracts energy therefrom for rotating the HPT 20 and in turn rotating and powering the compressor 14 through a conventional shaft 28.

As illustrated in more particularity in FIG. 2, the turbine nozzle 18 includes a plurality of circumferentially spaced nozzle vanes 30 which channel and direct the combustion gases 26 through a plurality of circumferentially spaced turbine blades 32 of the HPT 20. A pressure differential in the combustion gases 26 exists across the nozzle 18 which results in a resultant axial force $F_a$ extending in a downstream direction, and a resultant torque T relative to the centerline axis 12. This axial force $F_a$ and torque T must be suitably transmitted from the nozzle 18 to a conventional annular engine casing 34 as shown in FIG. 1 surrounding the compressor 14, combustor 16, nozzle 18, and HPT 20. Part of this force is transmitted through a turbine support 49. The remainder of this force is transmitted though compressor discharge duct or flowpath structure 36 which is disposed between the compressor 14 and the combustor 16 for channeling the compressed airflow 24 downstream therebetween.

More specifically, referring to FIG. 3, an OGV assembly 37 includes a plurality of circumferentially spaced radially extending outlet guide vanes OGVs 42 extend between and are fixedly joined to outer and inner annular OGV walls 38 and 40 respectively and which are disposed coaxially about the centerline axis 12. Briefly referring to FIG. 3*a*, outlet guide vanes 42 have airfoil like cross-sections 60 that include a leading edge 62, a relatively thick middle section 64, and a thin trailing edge 66.

Referring again to FIG. 3, a diffuser 48, having an inner diffuser casing 41, an outer diffuser casing 43, and radially extending dividers 45 therebetween extends downstream from the OGVs 42. Conventional flowpaths have inner OGV walls supported by (and typically welded to) diffuser casings and outer OGV walls supported by (and typically welded to) outer diffuser casings for both support and to maintain an essentially leak proof compressor discharge flowpath structure. The present invention provides a flowpath structure 36 that does not weld these flowpath walls together essentially decoupling them and therefore avoids the stresses induced in the trailing edges of the OGV's 42 in accordance with one feature of the present invention. Outer and inner annular OGV walls 38 and 40 are spaced apart and are disposed coaxially within inner and outer lip like extensions 45 and 47 respectively of corresponding inner diffuser casing 41 and outer diffuser casing 43 to provide a rabbit or snap fit of the OGV assemby 37. This feature provides radial alignment of outer and inner annular OGV walls 38 and 40 and corresponding inner and outer diffuser casings 41 and 43.

An outer diffuser support 44 extends axially between and is fixedly joined to the engine casing 34 and the OGV outer wall 38, and an annular inner diffuser support 46 extends axially between and is fixedly joined to the inner diffuser casing 41 and the turbine nozzle 18 (shown in FIG. 1). Since the inner diffuser support 46 itself is subject to a pressure differential in the downstream direction below the nozzle 18 due to the compressed airflow 24, as is conventionally known, the axial force therefrom is a substantial component of the axial force $F_a$ which is carried through the flowpath structure 36.

This embodiment of the present invention provides an outer guide vane support 68 including an inner conical OGV support member 70 supports inner annular OGV wall 40 at its forward end 72 and is bolted, at its aft end 74, to the inner diffuser support 46. The inner conical OGV support member 70 supports inner annular OGV wall 40 at point radially aligned with an axially extending relatively thick middle section 64 (shown in FIG. 3*a*) of OGV 42.

The axial force $F_a$ and the torque T from the nozzle 18 (shown in FIG. 1) are effectively carried through the diffuser 48 and no axial force or bending moment is transferred to the OGV walls to induce stress on the OGV's 42 in accordance with one feature of the present invention. Differential thermal stresses between the outer OGV wall 38 and the outer diffuser casing 43 and between the inner OGV wall 40 and the inner diffuser casing 41 have also been eliminated in accordance with a second feature of the present invention. The compressor discharge flowpath structure 36 may, in accordance with the present invention, be in the form of and include either conventional outlet guide vanes or a conventional diffuser while still being effective for carrying the axial force $F_a$ and torque T.

The flowpath structure 36 is made essentially leakage free by using inner and outer W seals 51 and 53 between corresponding outer OGV wall 38 and the outer diffuser casing 43 and between the inner OGV wall 40 and the inner diffuser casing 41 having flanges and sealing surfaces suitable to seal with the W seals.

A second embodiment of the present invention, illustrated in FIG. 4, provides a guide vane support generally shown at 168 for OGV assembly 37. Guide vane support 168 includes outer and inner conical guide vane support members 170 and 180 respectively. Outer conical OGV support member 170 is mounted to or may be integral with and supports outer annular OGV wall 38 at a forward end 172 of OGV support member 170 and, at its aft end 174, is bolted and sealed to a flange 176 on the outer diffuser casing 43. OGV support member 170 supports outer annular OGV wall 38 an axial location generally aligned with and corresponding to an axially extending relatively thick middle section 64 (shown in FIG. 3*a*) of OGV 42. An inner conical OGV support member 180 supports inner annular OGV wall 40 in the same manner but is not bolted to its corresponding inner diffuser casing 41. Rather the flowpath structure 36 between inner OGV wall 40 and inner diffuser casing 41 is sealed by an annular W seal 150 disposed between suitable sealing surfaces of inner conical guide vane support member 180 and inner diffuser casing 41. Thus, the second more particular embodiment provides an essentially leak free flowpath structure 36 and greatly reduces bending moments and stresses which may cause the OGV trailing edge to fail.

While there have been described herein what are considered to be preferred embodiments of the present invention, other modifications of the invention shall be apparent to those skilled in the art from the teachings herein, and it is, therefore, desired to be secured in the appended claims all such modifications as fall within the true spirit and scope of the invention.

Accordingly, what is desired to be secured by Letters Patent of the United States is the invention as defined and differentiated in the following claims:

1. A gas turbine engine outlet guide vane support apparatus for a compressor outlet guide vane (OGV) assembly having inner and outer annular outlet guide vane walls, outlet guide vanes radially disposed therebetween and having thick middle sections and thin trailing edges said support apparatus comprising:

at least one annular outlet guide vane support member that supports one of the outlet guide vane annular walls along an axially extending portion circumscribing the thick sections of the outlet guide vanes.

2. A gas turbine engine outlet guide vane support apparatus as claimed in claim 1 wherein said outlet guide vane support member is attached to a turbine support assembly mounted to a gas turbine engine casing.

3. A gas turbine engine outlet guide vane support apparatus as claimed in claim 1 wherein said outlet guide vane support member is attached to a compressor discharge diffuser support assembly mounted to a gas turbine engine casing.

4. A gas turbine engine compressor discharge apparatus comprising:

a compressor outlet guide vane outlet guide vane assembly having inner and outer annular outlet guide vane walls with radially extending outlet guide vanes mounted therebetween, said outlet guide vanes having a relatively thick section and a relatively thin trailing edge, and at least one annular outlet guide vane support member that supports one of the outlet guide vane annular walls along an axially extending portion circumscribing the thick sections of the outlet guide vanes.

5. A gas turbine engine compressor discharge apparatus as claimed in claim 4 further comprising:

an annular compressor discharge flowpath bounded by said outer and inner annular outlet guide vane walls and corresponding outer and inner leading edges of outer and inner diffuser casings, said corresponding inner and outer annular outlet guide vane walls in generally abutting relationship with said leading edges of respective inner and outer diffuser casings.

6. A gas turbine engine compressor discharge apparatus as claimed in claim 5 further comprising:

inner and outer annular outlet guide vane support members that support said inner and outer outlet guide vane annular walls respectively along axially extending portions circumscribing said thick sections of the outlet guide vanes.

7. A gas turbine engine compressor discharge apparatus as claimed in claim 6 further comprising:

said inner annular outlet guide vane support member supporting said inner outlet guide vane annular wall at a first inner support member end, a second inner support member end of said inner annular outlet guide vane support member disposed in axially abutting relationship with a radially inwardly extending flange like extension of said inner diffuser casings, and said outer annular outlet guide vane support member having a outer support member end sealing attached to a radially outwardly extending flange like extension of said outer diffuser casings.

8. A gas turbine engine compressor discharge apparatus as claimed in claim 5 further wherein said annular outlet guide vane support member is an inner annular outlet guide vane support member supporting said inner outlet guide vane annular wall at a first inner support member end, a second inner support member end of said inner annular outlet guide vane support is attached to a turbine support assembly mounted to a gas turbine engine casing.

9. A gas turbine engine compressor discharge apparatus as claimed in claim 4 further comprising:

lip like extensions on outer and inner leading edges of outer and inner diffuser casings effective for providing snap fit engagement of said corresponding outer and inner annular outlet guide vane walls.

* * * * *